US008191602B1

(12) United States Patent
Motosko

(10) Patent No.: US 8,191,602 B1
(45) **Date of Patent: *Jun. 5, 2012**

(54) SHUTTER SLAT ASSEMBLY FOR ROLL DOWN STORM SHUTTERS

(76) Inventor: Stephen J. Motosko, Sarasota, FL (US)

( * ) Notice: Subject to any disclaimer, the term of this patent is extended or adjusted under 35 U.S.C. 154(b) by 110 days.

This patent is subject to a terminal disclaimer.

(21) Appl. No.: 12/492,171

(22) Filed: Jun. 26, 2009

Related U.S. Application Data

(63) Continuation-in-part of application No. 12/148,867, filed on Apr. 23, 2008.

(51) Int. Cl.
*E06B 7/28* (2006.01)
*E06B 7/08* (2006.01)

(52) U.S. Cl. ..... 160/180; 49/92.1

(58) Field of Classification Search ..... 160/133, 160/235, 236, 180; 49/92.1
See application file for complete search history.

(56) References Cited

U.S. PATENT DOCUMENTS

| | | | | | |
|---|---|---|---|---|---|
| 1,592,667 | A | * | 7/1926 | Lewis | 454/132 |
| 1,812,595 | A | * | 6/1931 | Larson | 454/211 |
| 1,929,219 | A | * | 10/1933 | Sevison | 49/171 |
| 2,208,039 | A | * | 7/1940 | Mills | 160/133 |
| 2,390,116 | A | * | 12/1945 | Michelman | 160/133 |
| 2,585,627 | A | * | 2/1952 | Cornell et al. | 160/180 |
| 2,592,888 | A | * | 4/1952 | Greegor | 160/236 |
| 2,596,873 | A | * | 5/1952 | Solmes | 296/97.8 |
| 2,621,726 | A | * | 12/1952 | Greegor | 160/235 |
| 2,624,263 | A | * | 1/1953 | Klein | 49/38 |
| 4,126,173 | A | | 11/1978 | Theuerkauff | |
| 4,175,357 | A | | 11/1979 | Goldhaber | |
| 4,332,287 | A | | 6/1982 | Stolpe | |
| 4,690,193 | A | * | 9/1987 | Morrison et al. | 160/133 |
| 4,842,036 | A | * | 6/1989 | Goodman | 160/166.1 |
| 4,913,216 | A | * | 4/1990 | Lemay | 160/236 |
| 4,988,142 | A | * | 1/1991 | Chandler et al. | 296/146.2 |
| 5,095,965 | A | * | 3/1992 | Higashiyama | 160/133 |
| 5,507,335 | A | * | 4/1996 | Yu | 160/235 |
| 5,560,416 | A | * | 10/1996 | Yu | 160/229.1 |
| 5,808,816 | A | * | 9/1998 | Yu | 359/810 |
| 6,041,847 | A | | 3/2000 | Lai | |
| 6,263,943 | B1 | * | 7/2001 | Lai | 160/133 |
| 2007/0175117 | A1 | | 8/2007 | Brown | |

* cited by examiner

*Primary Examiner* — Katherine W Mitchell
*Assistant Examiner* — Jaime F Cardenas-Garcia
(74) *Attorney, Agent, or Firm* — Gifford, Krass, Sprinkle, Anderson & Citkowski, P.C.

(57) ABSTRACT

A shutter slat assembly for a storm shutter, each slat assembly including an elongated horizontally extending hollow shutter slat having longitudinally extending formed outer edges configured to slidably, interlockingly connect with the next adjacent slat for limited pivotal movement between adjacent connected slats sufficient for rolled-up storage of the storm shutter. Each slat has a central port formed therethrough for viewing and light transmission through the port. An elongated transparent panel is also provided having a cross section slidably fitted into the slat and enlarged edge portions configured and spaced for dependent slidable engagement between and within inwardly facing grooves formed inwardly adjacent to the outer edges. The transparent panel covers the port while allowing a person to obtain a view and permit light transmission therethrough. Sliding opaque covers positioned within the slat and over the transparent panel allow for selective closure of light transmission.

8 Claims, 8 Drawing Sheets

SHUTTER SLAT ASSEMBLY FOR ROLL DOWN STORM SHUTTERS

CROSS-REFERENCE TO RELATED APPLICATIONS

This is a continuation-in-part of U.S. application Ser. No. 12/148,867 filed Apr. 23, 2008.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to roll-up shutters for storm and hurricane and security protection, and more particularly to a uniquely configured shutter slat assembly for storm shutters which includes a transparent viewing and light-transmitting portion formed therethrough.

2. Description of Related Art

Roll-up Storm shutters are well known and afford a great deal of window and interior protection from storms, hurricanes and from breaking and entering into a home or building through otherwise unprotected windows and doors. These roll-up shutters are formed of a plurality of interlocking horizontally extending slats which have limited pivotal motion therebetween and are typically arcuately configured in cross section to facilitate the roll-up storage of the storm shutters when not in use.

A significant drawback to such roll-up shutters is that they are traditionally formed of opaque plastic or metal material which does not permit light transmission therethrough. Therefore, when the storm shutters are deployed, the interior of the house or building is darkened substantially and the occupants, if any, cannot easily view the outside of the home or building through the closed and protected windows and doors.

A number of prior art devices related to storm shutters are known to applicant and are adapted to provide some light transmission features as well as to facilitate the exterior viewing by a person within the building as follows:

U.S. Pat. No. 6,263,943 to Lai teaches a modular rolling shutter comprised of vertically alternating rows of buckles and slats. Each slat is linked with the lower and upper buckles, allowing limited movement of the slats and buckles so that the modular shutter may be rolled and unrolled along tracks. The slats may be made of a transparent material allowing visibility without sacrificing weather resistance or security. U.S. Pat. No. 6,041,847 also to Lai discloses a building block for a rolling shutter made of plastic sheets.

A rolling door construction which is easily assembled and which includes a plurality of light-transmitting panels is taught in U.S. Pat. No. 4,332,287 to Stolpe. Snarli teaches a rollable or foldable shutter device for protecting, closing off or partitioning of areas, such as window areas in U.S. Pat. No. 5,456,305. The shutter is provided with panels made from a transparent material, such as polycarbonate, and hinges which are mounted so that it can be folded or rolled up. The hinges and the panels may be made in one piece. When the device is used, at least a part of the transparency remains.

U.S. Pat. No. 4,345,635 to Solomon discloses a rolling protective gate for store fronts or the like which is formed of a series of horizontally-extending transparent slats interconnected and articulated by a series of horizontally-extending metal rods. The transparent slats and metal rods are elongated, and each extends the full width of the building front access opening in which the rolling gate is mounted.

In U.S. Patent Application Publication No. US 2007/0175117, Brown teaches a storm shutter look out portal for storm shutters comprised of an assembly with an interior frame and an exterior frame enclosing at least one transparent panel in between, and also including a cover associated with the interior frame that is moveable from a closed position to an open position where the cover, the interior frame and the exterior frame, are all fabricated from materials that are resistant to the impacts anticipated during a hurricane or tropical storm.

Expired U.S. Pat. No. 4,690,193 to Morrison et al. discloses a rolling shutter characterized by an array of edge-adjacent, parallel shutter slats and full shutter width, clear shutter segments or links articulately interconnecting respective pairs of adjacent shutter slats. When spaced apart, the slats form therebetween a gap which exposes the clear link which permits passage of light over substantially the full extent of the gap. The clear links also provide a double hinge-like joint between adjacent slats.

Goldhaber teaches a protective enclosure for building openings such as windows and doorways wherein the protective enclosure comprises a peripheral frame member that circumscribes the openings and pivotally mounts a transparent shielding unit in U.S. Pat. No. 4,175,357.

A shutter with profiled strips made of transparent plastic is disclosed in U.S. Pat. No. 4,126,173 to Theuerkauff. U.S. Pat. No. 5,507,335 to Yu teaches a shutter with a plurality of slat units which have transparent portions through which an object behind the same can be viewed.

The present disclosure provides a still further improvement in the configuration of the shutter slat assembly for use in forming a storm shutter for roll-up storage and easy downward deployment. In this disclosure, an elongated viewing port is formed along each hollow opaque metal or plastic slat which is covered and made secure by a mating elongated transparent molded plastic panel slidably and lockingly engaged within inwardly facing grooves formed within the interior of the hollow slat. Interlocking outer edges of each slat connect with each next adjacent slat for limited pivotal movement to form the storm shutter. Two-part opaque sliding covers selectively open and close to control light transmission and privacy.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a shutter slat assembly for a storm shutter, each slat assembly including an elongated horizontally extending hollow shutter slat having longitudinally extending formed outer edges configured to slidably, interlockingly connect with the next adjacent slat for limited pivotal movement between adjacent connected slats sufficient for rolled-up storage of the storm shutter. Each slat has a central port formed therethrough for viewing and light transmission through the port. An elongated transparent panel is also provided having a cross section slidably fitted into the slat and enlarged edge portions configured and spaced for dependent slidable engagement between and within inwardly facing grooves formed inwardly adjacent to the outer edges. The transparent panel covers the port while allowing a person to obtain a view and permit light transmission therethrough. Sliding opaque covers positioned within the slat and over the transparent panel allow for selective control of light transmission.

It is therefore an object of this invention to provide an improved shutter slat assembly for storm shutters which facilitates outward viewing therethrough and light transmission into the home or building when the storm shutter is deployed for protection.

Still another object of this invention is to provide a hollow shutter slat for storm shutters which includes an easily assemblable four-part structure including a transparent panel and opaque covers which slidably engage into mating groove structure of the slat for economy and strength.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 1:
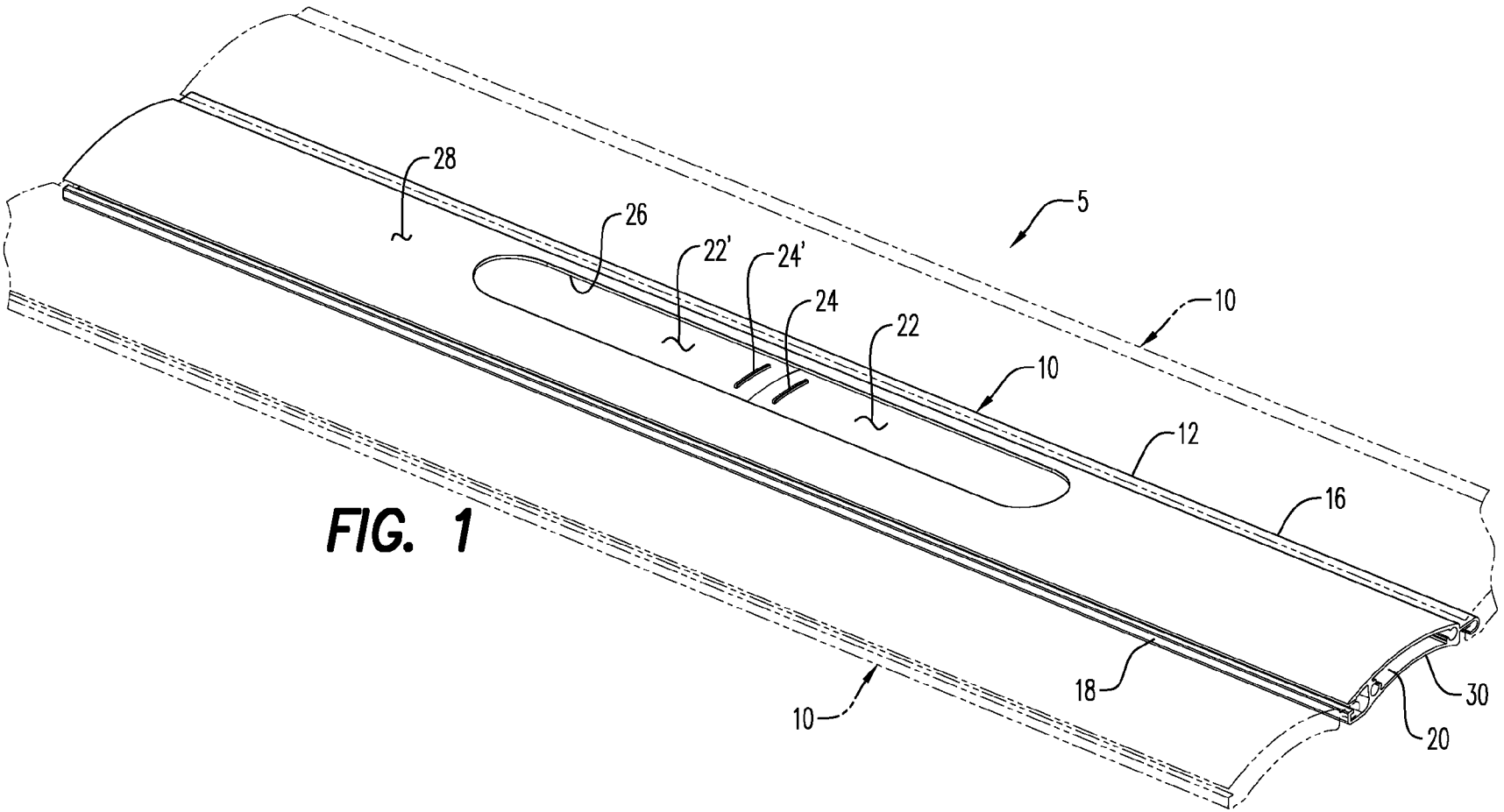
FIG. 1 is a perspective view of a shutter slat assembly 10.
Figure 7:
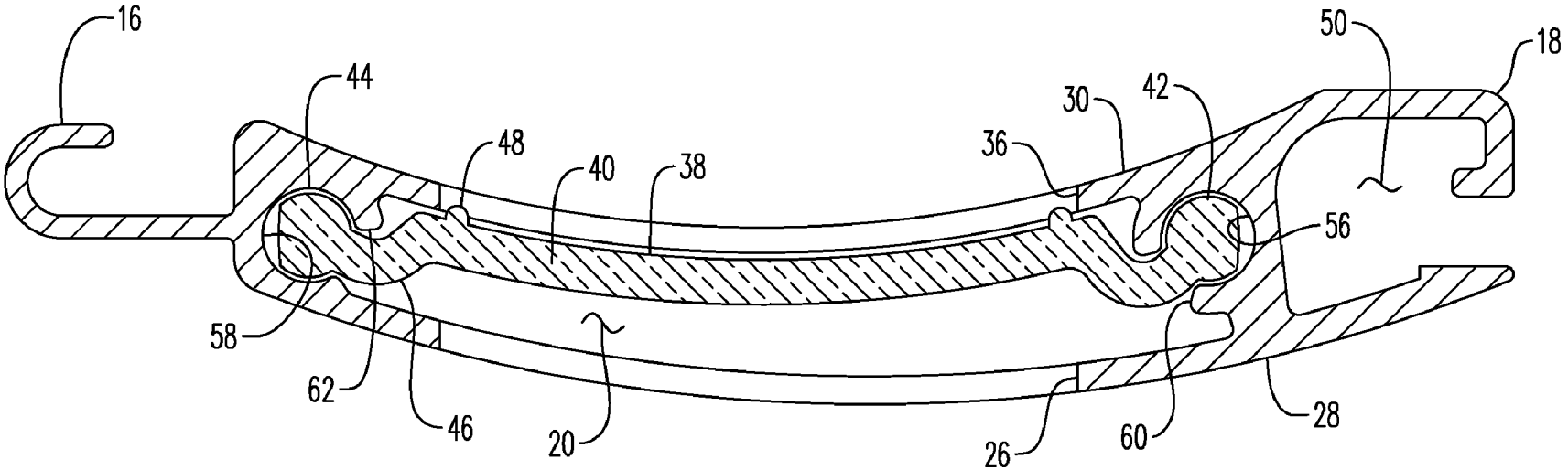
FIG. 7 is a section view in the direction of arrows 7-7 of FIG. 6.
Figure 8:
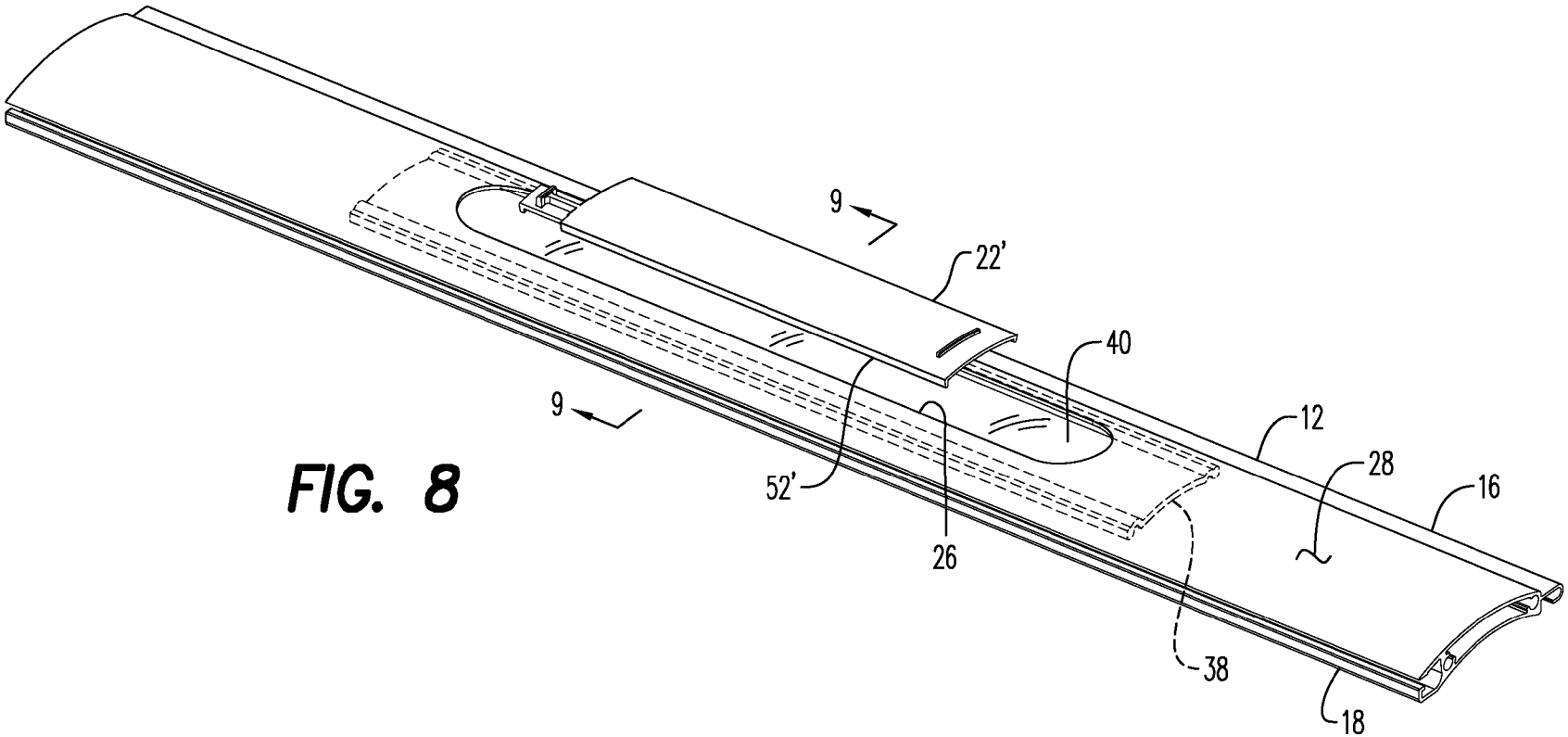
FIG. 8 is an exploded inner perspective view of FIG. 1 just prior to installation of one of the opaque cover panels.

Referring now to the drawings, the invention is there shown generally at numeral 10 and, in FIG. 1, is shown from the inside in conjunction with other such shutter slat assemblies 10 shown in phantom to form a storm shutter 5. Each assembly 10 includes an elongated preferably aluminum extruded hollow shutter slat 12 and a generally coextensive transparent molded or extruded plastic panel 38, both of which are arcuate in cross sectional configuration and generally similar to and mating one to another as best seen in FIG. 7. The shutter slat 12, again formed as one piece of extruded aluminum material, includes vertically oriented, outwardly facing outer edges 16 and 18. Outer edge 18 defines a channel 50 while outer edge 16 defines a hook structure which slidably, matably and entrappedly engages with the next adjacent outer edge 18, and so on, to form the storm shutter 5.

Each hollow slat 12 is formed having spaced outer and inner wall panels 28 and 30, respectively, connected by a pair of sides. The surface configuration of the wall panels 28 and 30 is preferably arcuate to facilitate the rolled up storage configuration of the storm shutter 5 when not in use. Immediately adjacent to the outer edges 16 and 18 within slat 12 are opposing generally inwardly facing C-shaped grooves 58 and 56 formed in the inner portion of the sides of the slat 12, respectively, best seen in FIGS. 7, 9A and 9B, the purpose of which will be described herebelow.

The slat 12 includes elongated aligned central ports 26 and 36 formed through the corresponding wall panels 28 and 30, respectively, which are provided to allow a person within a building to view the outside therethrough without having to elevate the storm shutter 5. Moreover, ports 26/36 also provide for light transmission into the building when the shutter 5 is deployed to illuminate or light the inside of the home or building for those inside.

Figure 5:
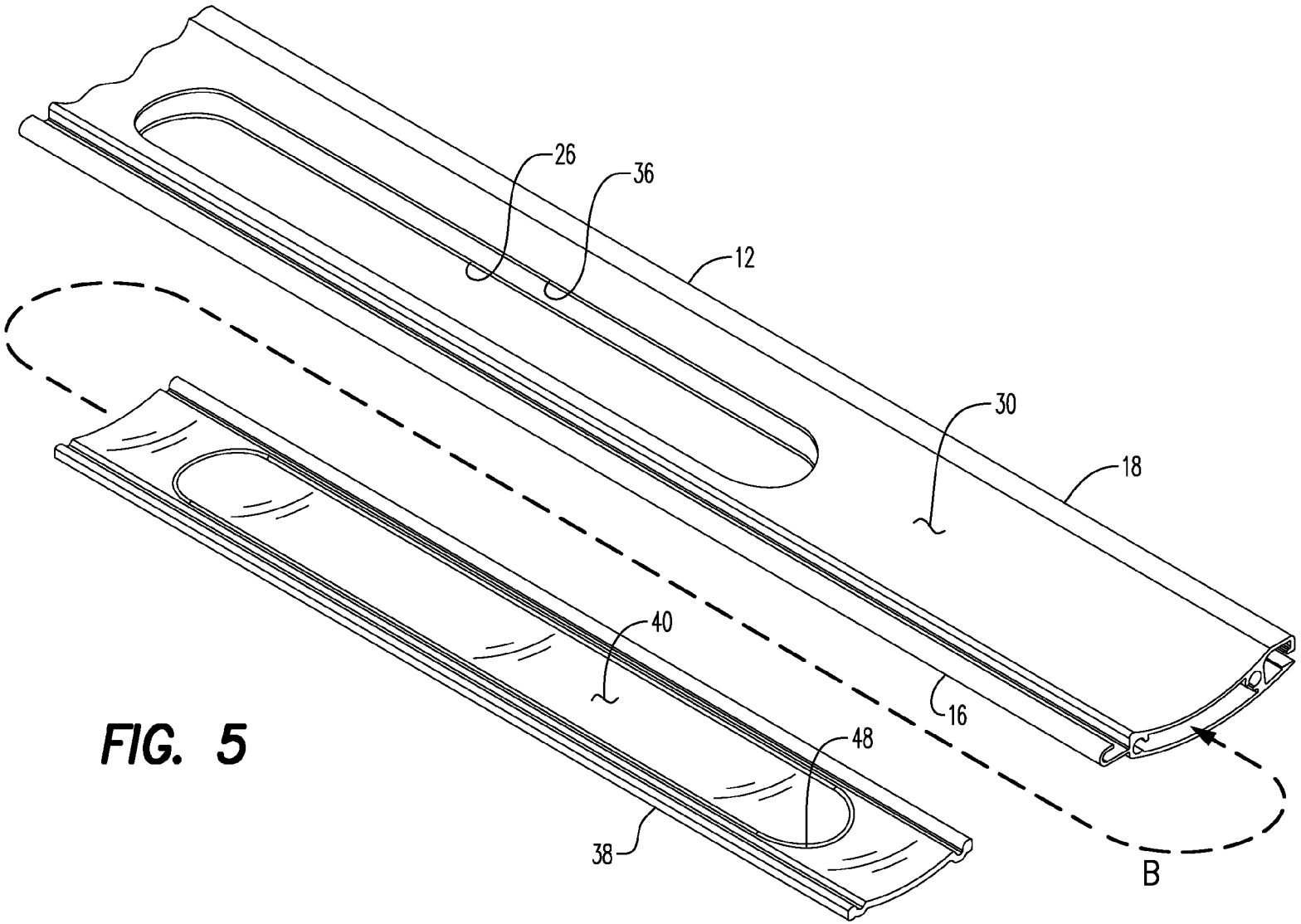
FIG. 5 is an exploded broken view of the hollow shutter slat and transparent viewing panel.
Figure 6:
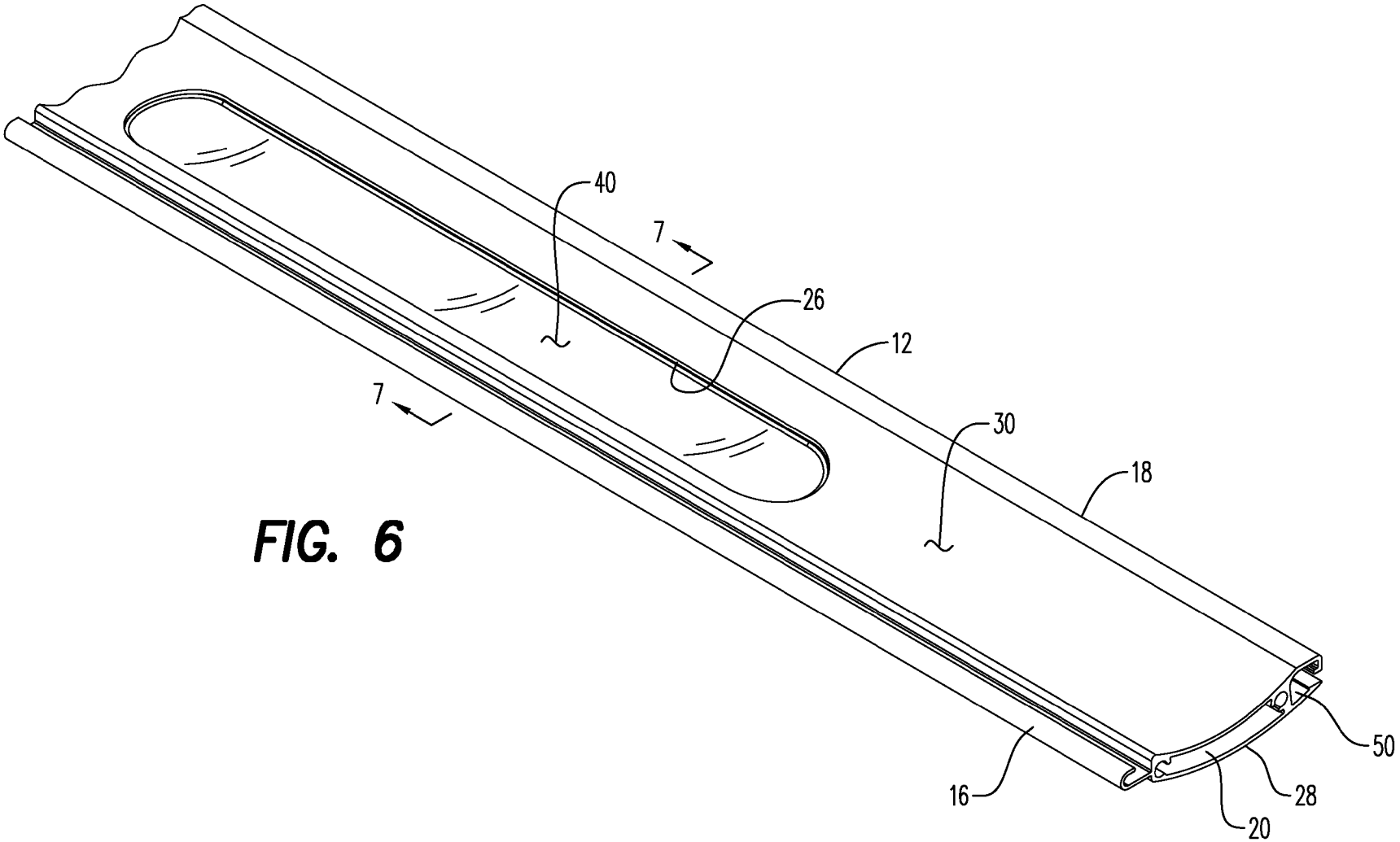
FIG. 6 is an outer perspective view of FIG. 5.
Figure 9A:
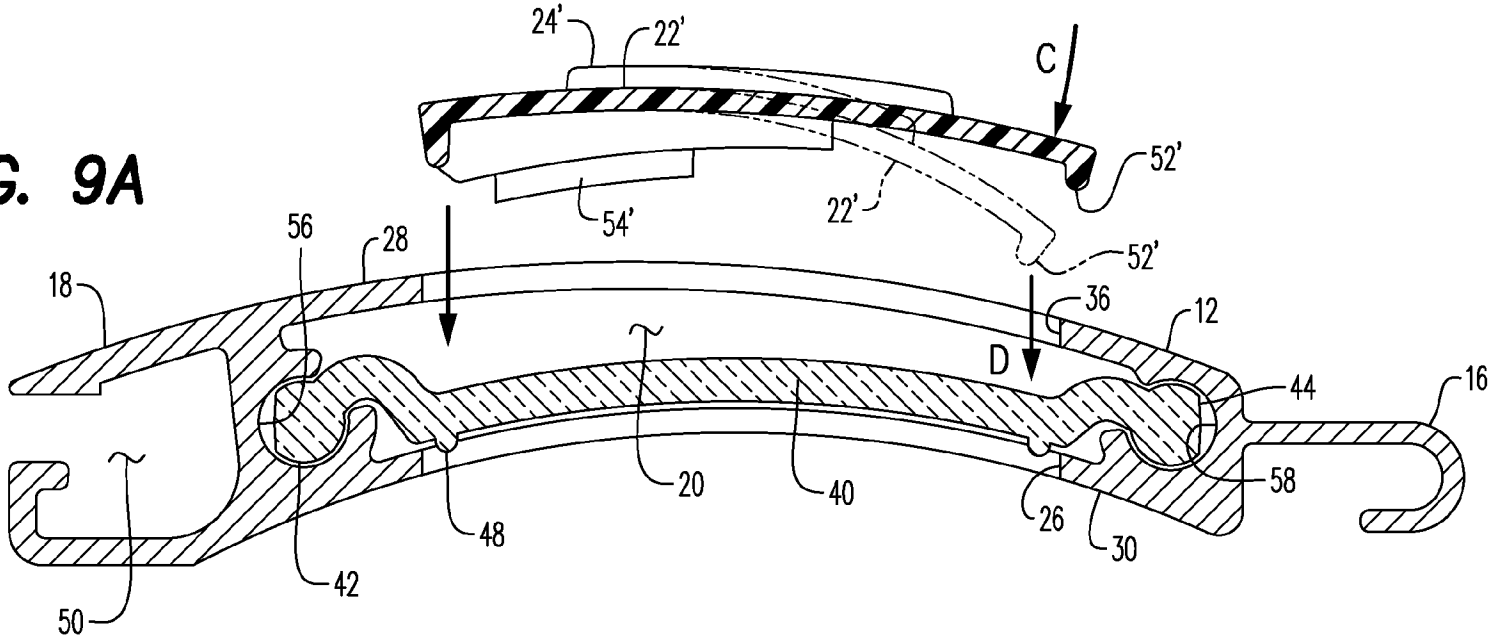
FIG. 9A is a section view in the direction of arrows 9-9 in FIG. 8.
Figure 9B:
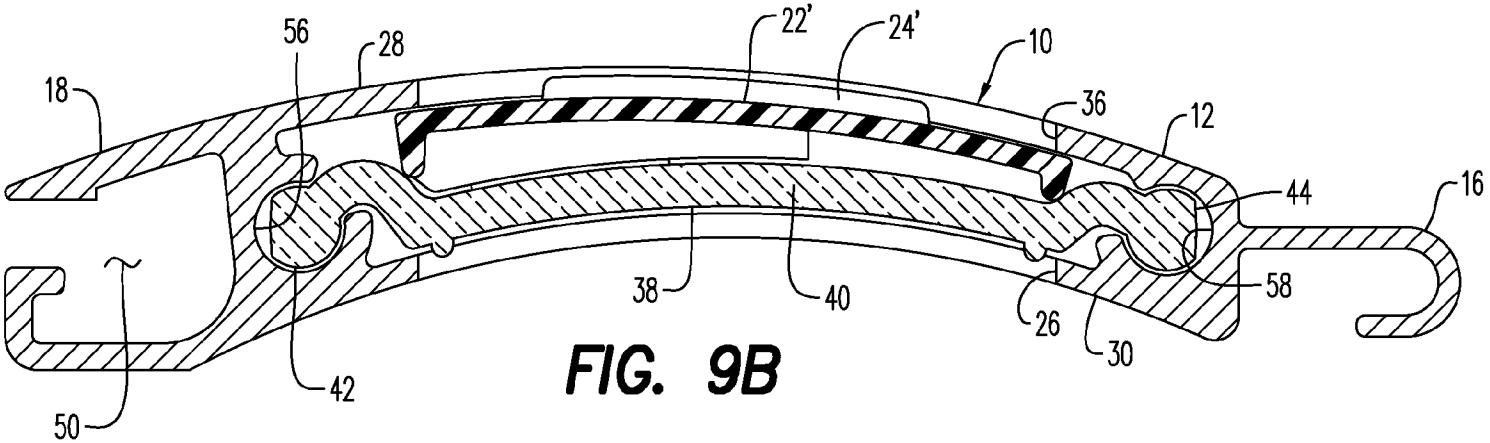
FIG. 9B is a fully assembled view of FIG. 9A.

The transparent panel 38 is molded of polycarbonate material for strength and has a convex arcuate surface which matably fits against the inner concave surface of wall panel 30 of the slat 12 as best seen in FIGS. 7, 9A and 9B. The transparent panel 38 includes shaped longitudinal edge enlargements 42 and 44 which are sized and spaced apart to snugly slidably engage within the grooves 56 and 58 when assembled into the slat 12 in the direction of arrow B in FIG. 5. This assembly arrangement positions and secures the transparent panel 38 centrally in and generally coextensive with the slat 12.

To prevent scratching of the inward concave arcuate surface 40 of the transparent panel 38, a preferably continuous bead 48 is formed on the outer facing surface thereof having a shape which substantially matches and mates into port 26. As the transparent panel 38 is slidably engaged in the direction of arrow B within grooves 56 and 58, the bead 48 may rub against the inner surface of wall panel 30 until the bead 48 snappingly engages into and within port 26 so that, once the transparent panel 38 is thusly installed, removal is difficult at best to secure this arrangement and rattling is minimized.

The preferred embodiment 10 also includes two opposingly longitudinally slidable opaque cover panels 22 and 22' which are disposed within the hollow interior of the slat 12 between the inner wall panel 28 and the transparent viewing panel 38. As best seen in FIGS. 9A and 9B, each of the cover panels 22 and 22', being slightly wider than the width of the port 36, are flexed in the direction of arrow C and then inserted through the port 36 in the direction of arrow D in FIG. 9A.

Figure 2:
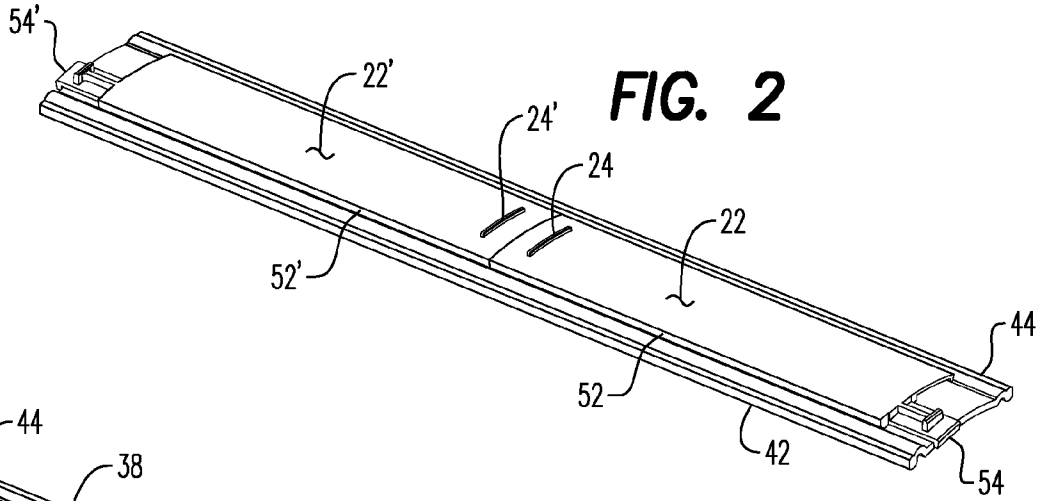
FIG. 2 is a perspective view of the opaque cover panels positioned atop the transparent panel of FIG. 1.
Figure 3:
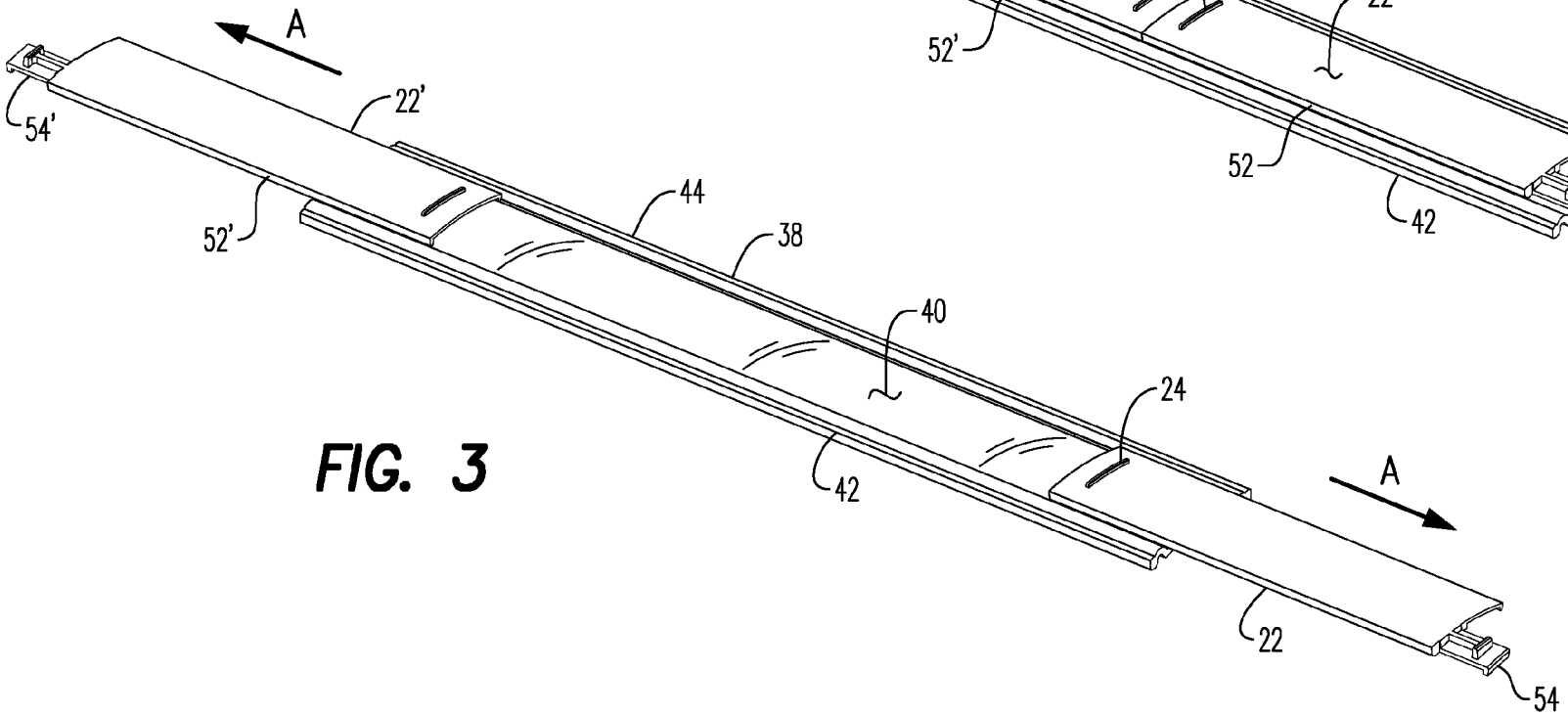
FIG. 3 is a perspective view of FIG. 2 showing the opaque cover panels in the open position.
Figure 4:
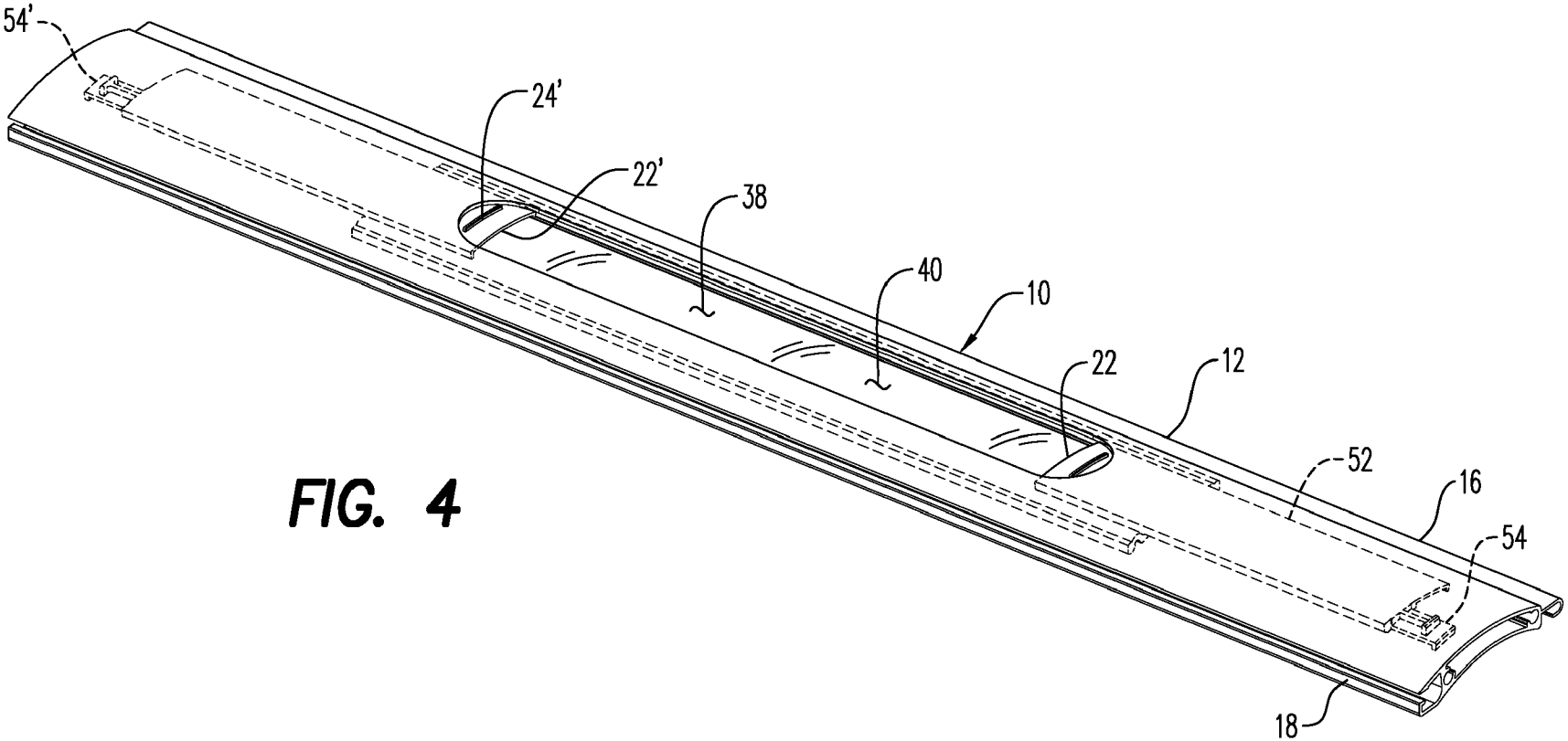
FIG. 4 is a view of FIG. 1 showing the opaque cover panels in the open position.

Each of the cover panels 22 and 22', include preferably continuous beads 52 and 52', respectively, which facilitate the sliding action against the convex surface of the transparent viewing panel 38. Handle ribs 24 and 24' facilitate the opening and closing of each of the cover panels 22 and 22' selectively in the direction of arrow A in FIG. 3. Stops 54 and 54' which bear against the corresponding end of the viewing panel 38 as best seen in FIG. 2, prevent each of the cover panels 22 and 22' from being slid longitudinally beyond the center point of the port 26. Note that, alternately, a single elongated cover panel may be provided which will be of sufficient length to slide within the slat 12, and span the entire port 26; however, because of assembly ease, two cover panels are preferred.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A shutter slat assembly for a storm shutter comprising:

a plurality of elongated horizontally extending shutter slats, each slat having a first wall and a spaced apart second wall, said first wall and said second wall having an arcuate central cross section, said first wall and said second wall interconnected by a first side and a second side which are formed as one piece with said first wall and said second wall to define a hollow interior of said slat, said first and said second sides having cooperatively configured longitudinally extending outer edges which slidably and interlockingly connect with a next adjacent said slat for limited pivotal movement between adjacent connected said slats sufficient for rolled-up storage of said storm shutter;

said first wall having a first port and said second wall having a second port aligned with said first port allowing a person to obtain a view through said first port and said second port;

an elongated transparent panel having a first surface a second surface, said panel having an arcuate cross section similar to that of said first wall and said second wall, said panel having enlarged shaped edge portions which are configured and spaced for dependent slidable engagement within said hollow interior of said slat between inwardly facing shaped grooves formed in said first and said second sides of said slat, said first surface being spaced apart from and facing said first wall and said second surface facing said second wall when said panel is engaged within said hollow interior of said slat in order to permit viewing and light transmission therethrough.

2. The shutter slat assembly of claim 1, further comprising:

an opaque cover panel disposed within said hollow interior of said slat between said first surface of said panel and said first wall of said slat, said cover panel being slidably lengthwise of said slat between a closed position substantially preventing light from passing through said central portion and an open position by manual sliding manipulation of said cover.

3. The shutter slat assembly of claim 1, wherein said grooves formed in said inner portion of each of said first side and said second side having a generally C-shape.

4. The shutter slat assembly of claim 1, wherein said second surface of said panel includes an outwardly extending bead which spaces said second surface from said second wall of said slat while said panel is being slidably installed within said hollow interior of said slat.

5. The shutter slat assembly of claim 4, wherein said bead has a shape complimentary to said second port such that said bead matingly engages within said second port to resist removal of said panel from said slat.

6. The shutter slat assembly of claim 1, wherein said slat is formed as an extrusion.

7. The shutter slat assembly of claim 6, wherein said slat is formed of a metallic material.

8. The shutter slat assembly of claim 1, further comprising:

a pair of opposing opaque cover panels disposed within said hollow interior of said slat between said first surface of said panel and said first wall of said slat, said cover panels being slidable lengthwise in opposing directions of said slat between a closed position substantially preventing light from passing through said central portion and an open position by manual sliding manipulation of said cover panels.

* * * * *